US005557680A

United States Patent [19]

Janes

[11] Patent Number: 5,557,680

[45] Date of Patent: Sep. 17, 1996

[54] LOUDSPEAKER SYSTEM FOR PRODUCING MULTIPLE SOUND IMAGES WITHIN A LISTENING AREA FROM DUAL SOURCE LOCATIONS

[76] Inventor: Thomas A. Janes, 3942 N. Cliff La., Cincinnati, Ohio 45220-1009

[21] Appl. No.: 425,856

[22] Filed: Apr. 19, 1995

[51] Int. Cl.[6] ..... H04R 5/00

[52] U.S. Cl. ..... 381/27; 381/24; 381/1; 381/188; 381/205

[58] Field of Search ..... 381/24, 27, 1, 381/17, 188, 205

[56] References Cited

U.S. PATENT DOCUMENTS

| | | | |
|---|---|---|---|
| 3,588,355 | 6/1971 | Holm | 381/24 |
| 3,637,938 | 1/1972 | Kuhlow et al. | 381/24 |
| 3,983,333 | 9/1976 | Allison . | |
| 4,133,975 | 1/1979 | Barker, III . | |
| 4,266,092 | 5/1981 | Barker, III . | |
| 4,286,688 | 9/1981 | O'Malley . | |
| 4,621,708 | 11/1986 | Potter . | |
| 4,723,289 | 2/1988 | Schreiber et al. . | |
| 4,764,960 | 8/1988 | Aoki et al. | 381/24 |
| 4,860,363 | 8/1989 | Suzuki et al. . | |
| 4,888,804 | 12/1989 | Gefvert . | |
| 4,961,226 | 10/1990 | Saffran | 381/24 |
| 5,117,459 | 5/1992 | McShane . | |
| 5,199,075 | 3/1993 | Fosgate | 381/24 |

*Primary Examiner*—Curtis Kuntz
*Assistant Examiner*—Minsun Oh
*Attorney, Agent, or Firm*—Wood, Herron & Evans, P.L.L.

[57] ABSTRACT

A loudspeaker system comprises two spaced-apart sound cabinets with the first cabinet housing a speaker driver directed toward a listener and couplable to a left channel signal to create a left channel sound image and a second speaker mounted in a second of the cabinets and couplable to a right channel to create a right channel sound image in a listening area. Third and fourth speaker drivers are positioned, one in each of the two sound cabinets, proximate to one of the first and second speaker drivers. The third and fourth drivers have axes which are angled with respect to the axes of the first and second drivers and are couplable to a signal having frequency components of center channels. The sound images created by the third and fourth drivers are focused inwardly in the listening area between the right and left channel sound images to create a focused center channel image in the listening area and thereby provide a listener with multiple-sound images generated from two sound cabinets for more realistic sound presentation.

30 Claims, 2 Drawing Sheets

LOUDSPEAKER SYSTEM FOR PRODUCING MULTIPLE SOUND IMAGES WITHIN A LISTENING AREA FROM DUAL SOURCE LOCATIONS

FIELD OF THE INVENTION

The present invention relates generally to a loudspeaker system for creating multiple sound images and more particularly to a loudspeaker system which produces multiple sound images in a listening area with a focused center source image from two speaker driver locations.

BACKGROUND OF THE INVENTION

Sound reproduction, and particularly sound reproduction of musical arrangements, continues to evolve. Early sound recordings were recorded on a single or mono channel and subsequently were reproduced by an audio signal generator which generated a mono channel signal and drove a single speaker driver with that signal. Although the mono channel presentation reproduced the recorded sounds or music, the sound was very flat and was not "lifelike". That is, the listener of the music would get a different sound sensation during replay of the recorded music as opposed to the sound sensation which would have been obtained by being in the presence of the performer when the music was performed.

With the advent of stereo recording, i.e., two channel recording, the music could be presented with two channel signals. Stereo sound systems are generally focused around a two channel source presentation utilizing two speaker drivers, one for each stereo channel. The stereo channels were designated as a left channel and a right channel. This generally signified the fact that the two speaker drivers would be separated and one would be to the left or right of the other, and vice versa. A two channel recording, when presented through two speaker drivers driven by two separate signals added the depth and width of music which was not achievable with a mono channel system. Therefore, stereo recording creates greater sound ambience and a more lifelike presentation of the music. With a stereo (two channel) system, the image that is created and perceived in the center is based upon the known concept that the perceived sound source created by the two separated speakers, to the extent that they produce the same or similar information, is midway between these sources. Amplitude (volume level) differences have the effect of moving the perceived center image side-to-side, moving the perceived image toward the higher level (volume) speaker. Further, by directing the speaker drivers inwards toward the listener (known as toe-in), their sound presentations will merge together reinforcing the center image. However, utilizing currently available systems, reinforcement or focusing the center image comes at the expense of degrading the spaciousness of the presentation. Maintaining or enlarging the spaciousness of the sound and taking advantage of the independent left and right portion of the sound recording by directing the speakers directly forward or slightly outwards (toe out), comes at the expense of degrading the perceived center image.

To further enhance the reproduction of music, early attempts were made to create a four channel system which involved a left front channel, a right front channel, a left rear channel and a right rear channel. When the four channel, or quad systems were introduced, they were not greatly accepted by the industry.

Recently, efforts have been directed to enhancing the reproduction of two channel recordings and specifically have been directed to how a listener hears and perceives sound from traditional two channel sources. Several of these efforts have focused upon presenting negative signals to cancel out certain sound. For example, a left cancellation signal would be used to cancel sound heard in the right ear while a right cancellation signal is utilized to cancel sound as heard by the listener in the left ear. Such techniques usually utilize a combination of a left minus right (L–R) or a right minus (R–L) signal to achieve the desired results. The primary problem with currently existing L–R and R–L techniques is that the listener, to receive and perceive cancellation signals, needs to be stationary and within a very narrow effective area or "sweet spot". As the listener and the corresponding listening position strays outside of the effective area, the signals lose their ability to cancel because the timing and strengths of the signals are not synchronized.

Other attempts have been made to address the sound levels which a listener hears based upon their position within the room and their proximity to the speaker drivers. These attempts utilize reflected sound, that is, sound bounced off back and side walls. However, such a focus is directed mainly to the levels of the sound and not to the actual integrity of the music. For example, adding additional artificial reflected sound into the room beyond that reflected sound which already exists in the original musical recording, injects a certain artificiality to the replayed music and creates a loss of direction of the source and loss of the musical sound integrity. The characteristics of reflected sound is inherently dependent upon the playback environment and to artificially create additional reflected sound results in signals which are not timed together. Furthermore, the spectrum of sound will differ based upon the reflecting surfaces it encounters when replayed (such as differing wall materials and glass). Therefore, even though existing reflecting sound systems might create more even noise level variations within a room, they do so to the detriment of the musical integrity.

One particular attempt to make sound variations more even as the listener changes positions within a room and with respect to the speaker drivers is set forth in U.S. Pat. No. 5,117,459. The system therein utilizes sound cancellation techniques, creating open "voids" along with left plus right (L+R), and left minus right and right minus left (L–R, R–L) channel signals to achieve its results. While the use of such channel manipulation may possibly result in a more even noise level, the integrity of the music is again sacrificed. The various combinations of left and right signals, including the L–R signal and the R–L signal, along with the L+ R signal create an overly vague sound image. Analogizing the mixing of the left and right signal channels with the mixing of colors, the result is a solid or mono sound which does not resemble the original recording similar to the dark or black color which is achieved when various colors of the spectrum are all mixed together. That is, the sound image as replayed is removed from the actual sound images that were recorded. Therefore, past attempts at enhancing a recreated sound image by manipulating the left and right channel signals have been inadequate.

Most recently, three channel recordings and decoding techniques have been utilized for enhanced reproduction of sound and music. These recordings are played by audio systems which produce a left channel signal, a right channel signal and center channel signals. Each of the left, right and center signals has a unique frequency characteristic which is distinct from the other channels. The addition of the center sound channel has further complicated the musical reproduction scheme by requiring a separate speaker driver to play the center channel which must be located with respect to the left and right channel speaker drivers within a room for proper sound reproduction.

One problem with the additional speaker driver for the center channel results from the spatial considerations of placing that speaker driver within a room. Traditionally, it has been sufficient to position one speaker at one side of a room and the other speaker at the other side of a room to create the desired sound image. To operate properly, however, the center speaker must somehow be positioned so that it plays the center channel signal with the right and left channels to produce the desired sound reproduction. As will be appreciated, the location of another speaker driver within a room while still maintaining the aesthetic quality of the room and specific arrangement of furniture, is a real problem. For example, positioning the speaker driver for the center channel in front of or close to a fireplace is not an attractive or practical choice. Furthermore, eliminating the speaker driver for the center channel for these reasons, limits the utilization of the current three channel Art.

Another inherent drawback of reproducing three channel recordings or multiple channel recordings (i.e. recordings with distinct channels that are a combination of the left, right and center channels) with a left speaker driver, a center speaker driver and a right speaker driver is that the center channel often carries a greater amount of information than the left and right channels. Therefore, the center channel information and the respective speaker driver become the predominant piece in the system. As such, this returns the Art (for this center information) back to a mono channel being played from a mono source. The resultant sound image is fixed at a location corresponding to the location of the center channel speaker driver and the overall reproduction tends to be flat and lifeless.

Therefore, it is an objective of the present invention to recreate a musical recording with depth and a more realistic perceived sound image. It is another objective of the present invention to manage the dominance of the center channel in a multi-channel audio system. It is another objective to eliminate the necessity of positioning an additional speaker driver and cabinet within a distinct location separate from the left and right speaker drivers. To that end, it is also an objective to maintain the integrity of the center channel signal and the sound image produced therefrom within the listening area while eliminating the distinct perceived location of a center channel speaker driver. It is another objective of the invention to provide a sound presentation of musical sound images which recreates the sound stage as recorded and reestablishes the depth and the spaciousness of the left to right, right to left, and center sound images to closely resemble live music presentations.

SUMMARY OF THE INVENTION

The present invention addresses the above-discussed objectives with a loudspeaker system which utilizes a unique configuration of speaker drivers which are coupled to a multiplicity of audio signal channels of an audio signal generator to more realistically recreate a musical recording in a listening area similar to the sound of the music on stage.

To that end, a loudspeaker system comprises two spaced apart sound cabinets for housing speaker drivers. The cabinets are preferably mirror images of one another. The sound cabinets are positioned to collectively define a front plane which generally faces the listening area. A first speaker driver is mounted in one of the cabinets while a second speaker driver is mounted in the other of the cabinets. The first and second speaker drivers are arranged to have their axes directed generally perpendicular to the defined front plane of the sound cabinets to project sound into the listening area. The first speaker driver is coupled to a left channel signal from an audio signal generator and is operable to receive the left channel signal and create a left channel sound image forward of the respective sound cabinet and in the listening area. The second speaker driver is coupled to a right channel signal and is operable to receive the right channel and create a right channel sound image forward of the cabinet and in the listening area, and generally to the right side of the left channel sound image.

The system further comprises third and fourth speaker drivers which are positioned respectively within the first and second cabinets next to but slightly spaced from the first and second drivers in those cabinets. In accordance with the principles of the present invention, the third and fourth speaker drivers are configured to be each coupled to a signal having components of a third channel. Preferably, the third channel signals coupled to the third and fourth speaker drivers have components of a center channel and may be purely a center channel or a center channel in combination with the left or right channels, respectfully, with center channel components.

The axes of the third and fourth drivers are oriented at an angle with respect to the plane defined by the sound cabinets and with respect to the axes of the first and second drivers to which they are adjacent. The third and fourth speaker drivers cooperate to create a third channel sound image, such as a center channel sound image with center channel frequency components, in the listening area forward of the sound cabinets. Preferably, the center channel sound image is created generally between the right and left channel sound images in the listening area. To that end, the axes of the third and fourth speaker drivers are angled with respect to the generally parallel axes of the first and second speaker drivers at an angle in a range of approximately 20°–45° and are directed forward into the listening area and inwardly between the parallel axes of the first and second speaker drivers such that the axes of the third and fourth speaker drivers intersect forward of the sound cabinets in the listening area.

The focused third channel drivers create a center channel sound image while eliminating the need for a separate dedicated sound cabinet with speaker drivers for playing the center channel. With a sound image from each cabinet containing center channel components, the invention eliminates the fixed location of the center sound image and thus reestablishes the depth of the center channel sound image to recreate the musical presentation as recorded. The loudspeaker system creates an accurate and well balanced sound image with direct sound from each channel as opposed to various artificial sound images utilizing the addition and subtraction of the left and right channels and artificially created reflected sound. Furthermore, through the use of direct sound, the integrity of the music is maintained. As a result, the sound image as presented by the loudspeaker system of the present invention creates a wider listening area of music but without the small "sweet spot" associated with various other sound systems. The present invention also eliminates the problems of emphasizing the center image at the sacrifice of the speciousness (toe in), or emphasizing the speciousness of the presentation at the sacrifice of a focused center image (toe out). The present invention also eliminates timing problems associated with a dedicated speaker driver location for playing the center channel because the center channel sound image of the invention is created from speaker drivers located within the sound cabinets containing the speaker drivers playing the left and right channels. Therefore, the present invention recreates the musical sound stage as it was recorded and presents sound images from the sound stage as they were created in the live musical performance without establishing the location of the sound images as the location of the speaker drivers themselves or as the location of sound images which did not exist in the music as recorded (i.e., added and subtracted left and right channel signals).

By presenting this center image information from multiple sources focused forward towards the center, the depth of sound is represented and lifelike. In accordance with the principles of the present invention, the advantages of this multiple source presentation of a mono center source is dramatic and might be simply illustrated and experienced as follows: 1) Play music (preferably music that incorporates a vocalist) from a standard stereo system with the speakers "toed in" towards the listening position, in the mono mode, with the balance fully to one side (only one speaker playing); 2) Listen to the music facing directly towards the speaker (which is playing) with eyes closed; 3) Next, turn facing directly forward, between the two speakers, and play the mono source from both the left and right speakers. Even though a mono source is being presented, the presentation will have depth and will be significantly more lifelike. From the present invention and human perception of multiple sound sources, a center focused image is maintained, without the flatness of a single source presentation.

The present invention may be utilized with other sound sources; such as rear surround speaker drivers and/or a sub woofer.

The above and other objectives and advantages of the present invention shall be made apparent from the accompanying drawings and the description thereof.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
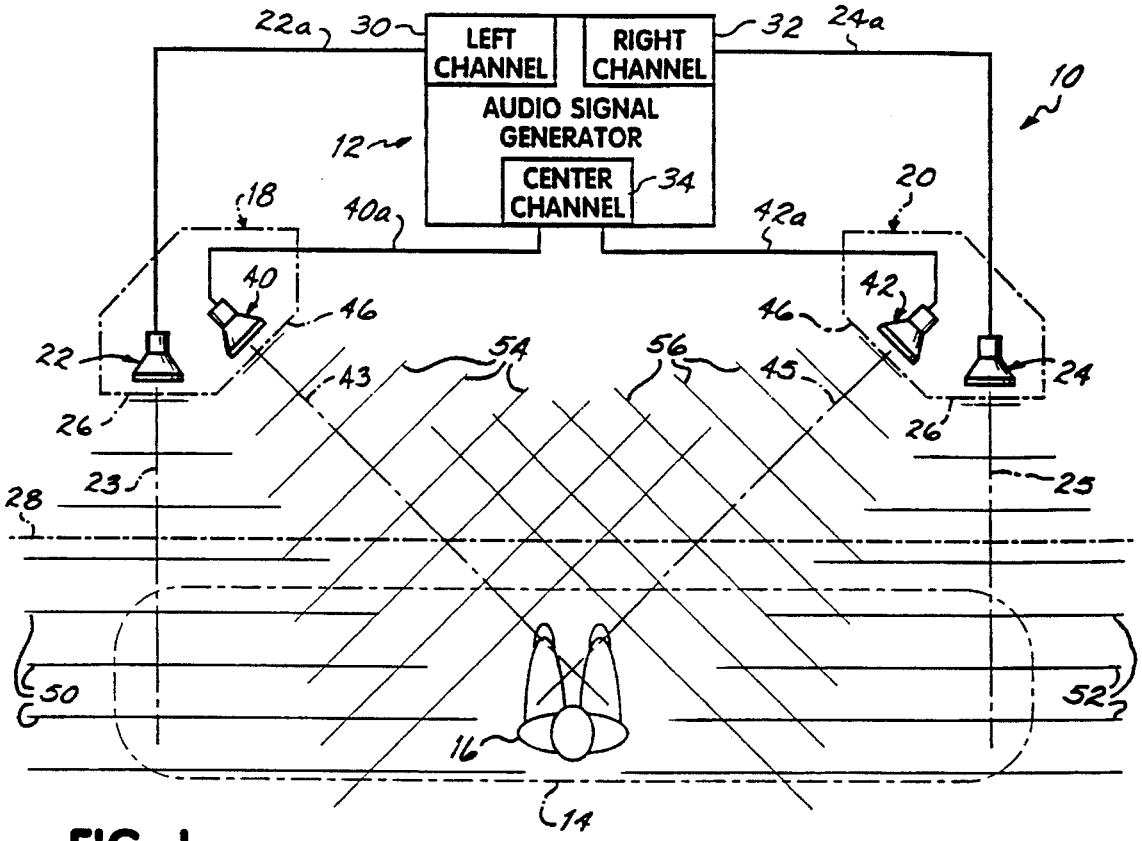
FIG. 1 is a top schematic view of the loud speaker system of the present invention utilized within a listening area containing a listener.

FIG. 1 illustrates the system 10 of the present invention comprising an audio signal generator 12 to produce a deep, rich and accurate reproduction of sound within a listening area 14 containing a listener 16.

System 10 comprises a left side sound cabinet 18 positioned generally to the left side of listener 16 and a right side sound cabinet 20 positioned generally to the right of the listener 16. For the purposes of illustrating the invention, the terms left and right when used to spatially define an object herein are made with reference to the left hand and right hand side of the listener 16.

Figure 3:
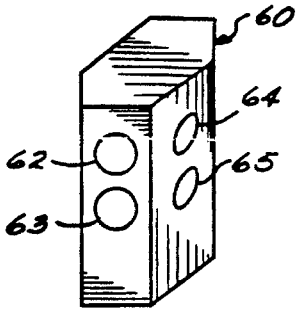
FIG. 3 is a perspective view of an alternative embodiment of a left side sound cabinet with speaker drivers in accordance with principles of the present invention; the matching right side sound cabinet is a mirror image of the cabinet illustrated.
Figure 4:
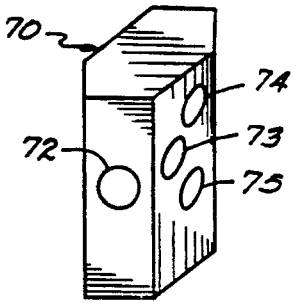
FIG. 4 is a perspective view of an alternative embodiment of a left side sound cabinet with speaker drivers in accordance with principles of the present invention; the matching right side sound cabinet is a mirror image of the cabinet illustrated.

The left side sound cabinet 18 includes a first speaker driver 22 with an axis 23 that is directed forwardly into listening area 14. Sound cabinet 20 also includes a similar speaker driver 24 which is directed forwardly into the listening area 14 and has an axis 25. Preferably, the front face surfaces 26 of the sound cabinets 18, 20 are generally planar and exist in a plane parallel to the front face of the speaker drivers 22, 24 and generally perpendicular to the respective axes 23, 25. The speaker drivers 22, 24 and their respective axes 23, 25 define an imaginary sound plane 28 forward of the sound cabinets 18, 20 and generally facing the listening area 14. The defined plane 28 is an imaginary reference and will be utilized to define the position and orientation of the various speaker drivers and their axes in accordance with the principles of the present invention. The term speaker driver as utilized herein is descriptive of an electrical sound-producing element which receives a frequency signal and creates a corresponding sound, such as music, which is defined by the frequency makeup of the corresponding signal. The speaker drivers, such as drivers 22, 24, for example, may be unitary elements or might actually be a combination of elements as is illustrated in FIGS. 3 and 4 and described further herein. The multiple elements of a defined driver would cooperate to produce a single or unitary sound image.

The audio signal generator 12 is a multiple signal generator such as an amplifier which amplifies signals from a variety of sources, such as cassette players, CD players, tuners or phonographs. When playing music recorded with multiple channels, the generator preferably recreates multiple audio channel signals and more preferably recreates three audio signals or three channels. Specifically, generator 12 recreates a left channel signal 30, a right channel signal 32 and a center channel signal 34. The center channel generator alternatively may produce two center signals, such as a left center signal and right center signal, which are coupled, respectively, to speaker drivers 40 and 42 through appropriate and respective lines **40*a* and 42*a*. Each of the left, right and center channel signals are all distinct and contain unique frequency components which are defined when the music is recorded or encoded. The audio signal generator 12 decodes or creates the recorded channels and produces signals corresponding to those channels for playback through the system 10** of the present invention.

As discussed above, system 10 further comprises third and fourth speaker drivers 40, 42 which are defined as center channel drivers, although the signal played through drivers 40, 42 may contain other components than just center channel components. Speaker driver 40 is mounted within sound cabinet 18 generally horizontally spaced from the left channel driver 22 and at an angle thereto. More specifically, speaker driver 40 has an axis 43 which is oriented at an angle with respect to axis 23. Somewhat similarly, speaker driver 42 is positioned in sound cabinet 20 proximate and slightly horizontally spaced from speaker driver 24. The axis 45 of driver 42 is oriented at an angle to axis 25. As illustrated in FIG. 1, one embodiment of the sound cabinets 18, 20 utilizes side planes 46 which are parallel to the faces of the speaker drivers 40, 42 and generally perpendicular to their respective axes 43, 45. As such, the left side sound cabinet 18 and right side sound cabinet 20 are mirror images of one another. The speaker drivers 40, 42 are directed inwardly and forward into the listening area, such that their axes 43, 45 intersect in the listening area 14 between the sound cabinets 18, 20.

In accordance with the principles of the invention, speaker driver 22 is configured to be coupled to the left channel signal 30 through an appropriate conductor line **22*a* and is operable for receiving the left channel signal and producing a left channel sound image illustrated by lines 50 which projects into the listening area 14 to be perceived and heard by the listener 16. For reference purposes, the left channel sound image is illustrated by lines 50 to visually depict the traveling of sound from driver 22 into listening area 14. When sound comes from a speaker driver, it is generally directed forward of the driver in the direction of its axis, such as axis 23 for driver 22, and the sound waves spread apart in the horizontal and vertical directions as the sound moves away from the location of the driver 22 or sound cabinet 18. The horizontal spread of the sound is illustrated in FIG. 1. Similarly, the right side sound cabinet 20 and speaker driver 24 are coupled to the right channel signal by line 24*a* and create a right channel sound image illustrated by lines 52 within listening area 14 to be perceived by the listener 16**.

In accordance with the principles of the present invention, speaker driver 40 in the left side sound cabinet 18 and speaker driver 42 in the right side sound cabinet 20 are coupled to the center channel signal 34 through appropriate lines **42*a* and 40*a*. Speaker driver 40 thus creates a center channel sound image which is directed inwardly generally to the center of listening area 14 and toward listener 16. The center signal channel sound image from driver 40 is illustrated by the reference lines 54. Driver 42 also creates a center channel sound image which is directed inwardly to the center of listening area 14 and is illustrated by reference lines 56**.

Because of the angular orientation of drivers 40 and 42 with respect to drivers 22 and 24, the center channel sound images 54, 56 are at an angle with respect to the left channel sound image 50 and the right channel sound image 52. Drivers 40, 42 are angled forwardly into the listening area 14 and inwardly into the center of the listening area 14. The center channel sound images 54, 56 intersect such that the sound images merge together to create a reinforced center sound image across the listening area. The reinforced center sound image illustrated by the intersecting lines of the individual center sound images 54, 56 is located generally midway between the sound cabinets 18, 20 and drivers 40, 42. However, because of the spread of sound of each of the sound images 54, 56, the perceived center sound image will generally be across the width of the listening area 14. Therefore, the reinforced center sound image provides a depth of sound across the listening area 14 as perceived by listener 16. The left and right sound images 50, 52 cooperate with the reinforced center sound image to create a broad, deep and spacious perceived sound image from left to right (or right to left) across listening area 14. The center channel sound image is created without a dedicated center channel sound cabinet while maintaining the contents of the center channel and removing the locality of the center channel with respect to the listener 16. The present invention produces a deeper and more realistic sound image for listener 16 without a localized center channel sound image, while maintaining the spaciousness of the presentation.

Furthermore, the sound perceived by listener 16 is created by primarily direct sound images which recreate the sound, such as music, as it was recorded as opposed to a system which attempts to create sound environments by utilizing artificially reflected and/or electronically modified signals, e.g., L–R, R–L techniques. In that way, the sound images created and perceived by listener 16 are faithfully presented and recreate a live performance presentation without creating an environment foreign to the original music as was recorded. Furthermore, since a dedicated center channel sound cabinet is not necessary, the aesthetics of the invention, which utilizes the traditional two sound cabinets 18, 20, far surpasses the look of a three or multi-sound cabinet system within a room. The present invention thus eliminates the need to rearrange a room of furniture in order to provide proper placement of a center channel sound image.

Figure 2:
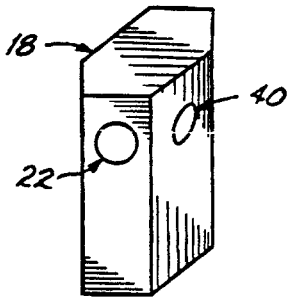
FIG. 2 is a perspective view of one embodiment of a left side sound cabinet with speaker drivers in accordance with principles of the present invention; the matching right side sound cabinet is a mirror image of the cabinet illustrated.

FIG. 2 illustrates a left side sound cabinet similar to sound cabinet 18 in FIG. 1. Speaker driver 22 is horizontally spaced to one side of speaker driver 40. Speaker driver 40, in turn, is angled with respect to driver 22 to face inwardly and forward into the listening area when the cabinet 18 is positioned with driver 22 facing the listening area 14 and its axes 23 intersecting and generally perpendicular to the defined sound plane 28.

FIG. 3 illustrates an alternative embodiment of a sound cabinet which might be utilized in the present invention. The sound cabinet of the FIGS. 2, 3, 4 and 5 are all configured to be left side sound cabinets, and as will be appreciated by a person of ordinary skill in the art, the right side sound cabinets would preferably be mirror images of the left side sound cabinets. Sound cabinet 60 includes multiple speaker drivers 62, 63 which are coupled to the signal from left channel 30 to produce a left channel sound image. Drivers 62 and 63 may be operable to divide the frequency range of the left channel. For example, driver 62 might be a tweeter for playing higher frequencies while driver 63 might be a woofer for playing lower frequencies. Also, multiple mid range drivers (not shown) might be utilized to play frequencies between the ranges of the tweeter 62 and woofer 63. Similarly, multiple driver 64, 65 might be utilized to play the different frequency ranges associated with the signal from center channel 34. In sound cabinet 60, the speaker drivers of 62, 63 associated with the left channel are vertically spaced from one another while the speaker driver 64 and 65 are also vertically spaced from one another. The groups of driver 62, 63 and 64, 65 are then horizontally displaced from one another in accordance with the principles of the present invention and similar to the cabinet 18 illustrated in FIG. 2.

In another alternative embodiment of the sound cabinet, one face of the sound cabinet might include drivers producing sound images from both the center and one of the left or right channel signals. Specifically, sound cabinet 70 includes speaker driver 72 coupled to the signal of left channel 30. Another driver 73 is also coupled to the signal of left channel 30, but has an axis which is angled with respect to the axis of driver 72. The axis of driver 73 is generally parallel to the axes of drivers 74, 75 which are coupled to signal of center channel 34. Therefore, the center channel sound image will be accompanied by part of the left channel sound image which cooperates with the left channel sound image from driver 72 to create a sound image which is perceived to be seamless from the left side of the listening area to the right side of the listening area and vice versa. Therefore, part of the left channel sound image will be perceived as coming from a location between drivers 72 and 73. As may be appreciated, driver 73 may be angled at an angle between driver 72 and drivers 74, 75 to create a seamless sound image for the left or right channels.

Figure 5:
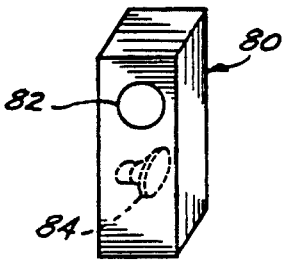
FIG. 5 is a perspective view of an alternative embodiment of a left side sound cabinet with speaker drivers in accordance with principles of the present invention; the matching right side sound cabinet is a mirror image of the cabinet illustrated.

FIGS. 2, 3 and 4 illustrate sound cabinets which orient and space the various speaker drivers for the left and right channels and the center channel horizontally with respect to each other. However, a left or right channel driver might also be spaced vertically with respect to the center channel driver. As illustrated in FIG. 5, sound cabinet 80 has an upper driver 82 which is configured to receive and play the sound signals of left channel 30. Speaker driver 84 is positioned vertically below driver 82 and generally in the same front surface or plane of cabinet 80. Driver 84 is angled with respect to driver 82 in accordance with the principles of the present invention and is coupled to a signal of center channel 34 to produce a center channel sound image at an angle with respect to the left channel sound image in the listening area 14.

Figure 6:
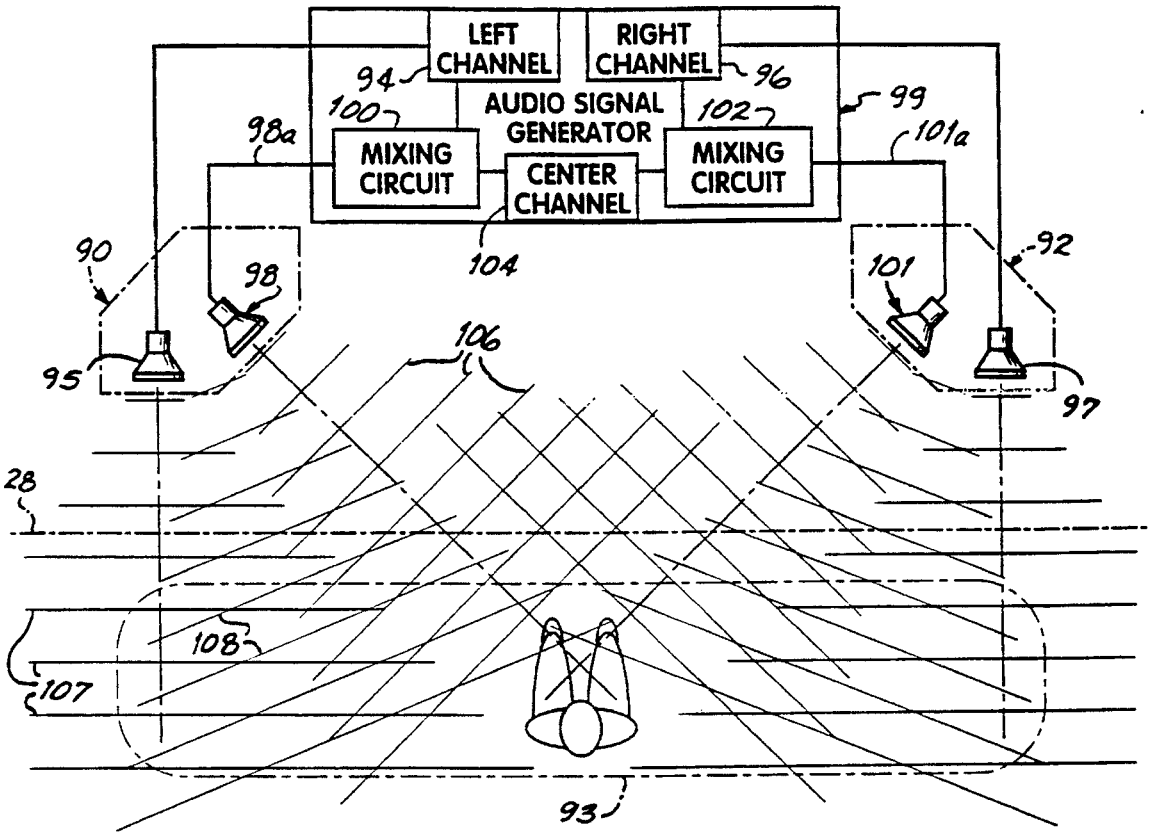
FIG. 6 is a top schematic view of an alternative embodiment of the present invention.

FIG. 6 illustrates an alternative embodiment of the present invention in which the signals played by the center channel drivers which are directed inwardly into the listening area also contain components from one of the left or right channels. Referring to FIG. 6, sound cabinet 90 and sound cabinet 92 are directed to generally face a listening area 93. The signal of left channel 94 is coupled to driver 95 while the signal of right channel 96 is coupled to driver 97. The audio signal generator 99 of the present invention includes signal mixing circuits 100, 102 which produce signals that are a combination of a center channel 104, and one of the left or right channels. That is, circuit 100 is operable to create a signal on line 98*a* which contains components of the center channel 104 and the left channel 94. Therefore, the center and left channel sound images illustrated by the lines 106 will cooperate with the left channel sound image illustrated by lines 107 to create a sound image illustrated by lines 108 which contains components of the left channel signal 94. Sound image 108 is perceived to exist from a location between drivers 95 and 98 to create a seamless perceived sound across the listening area 93. Similarly, the right side sound cabinet 92 creates a seamless sound image with drivers 97, 101 from a combination of the right channel signal 96 and center channel signal 104 created by circuit 102 on line 101*a*. The inwardly angled drivers 98, 101, receive signals which contain components of a center channel 104 to thus create the reinforced center channel sound in accordance with the principles of the present invention. However, because of the other channel component contents of the signals, such as left channel or right channel components, they further enhance the sound perceived by a listener in listening area 93 by creating a more seamless sound.

In a further alternative embodiment of the present invention, the center channel drivers 98, 101 might contain twin coils (not shown) wherein each coil is connected to the center channel 104 and one of a respective left channel 94, and right channel 96. The twin coils would create seamless sound with the left, right and center channels without circuits 100, 102 for electrically combining the center channel 104 with the signal of left channel 94 or the signal of right channel 96.

Therefore, the present invention recreates a musical sound stage as it was recorded and present sound images as they were created during a live musical performance without establishing the location of those sound images as specific location of the speaker drivers. Furthermore, since a center channel sound image is created from sound cabinet locations where the left and right channel sound images originate, there is coherent time arrival at the location of the listener within a listening area. Furthermore, the present invention manages the dominance of the center source without a dedicated sound cabinet. The integrity of the sound is maintained as recorded because the sound images are all created primarily by direct sound. Ultimately, a deeper, richer and more realistic sound image is perceived by the listener.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the Art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A loudspeaker system for producing, in a listening area, realistic sound images from an audio signal generator with a multiplicity of audio signal channels, the system comprising:

two spaced-apart sound cabinets for housing speaker drivers;

a first speaker driver mounted in a first of the defined cabinets and having an axis directed toward the listening area, the first driver configured for being coupled to a first channel signal of said audio signal generator and operable for receiving said first channel signal and creating a first channel sound image forward of the cabinet and into the listening area;

a second speaker driver mounted in a second of the cabinets and having an axis directed toward the listening area, the second driver configured for being coupled to a second channel signal of said audio signal generator and operable for receiving said second channel signal and creating a second channel sound image forward of the cabinet and into the listening area;

a third speaker driver mounted in said first cabinet and physically spaced from said first driver, the third driver having an axis oriented toward the listening area and at an angle to said first driver axis, the third driver configured for being coupled to a signal having frequency components of a third channel from said audio signal generator for receiving said signal and directing sound with third channel components into the listening area at an angle to the first channel sound image;

a fourth speaker driver mounted in said second cabinet and spaced from said second driver, the fourth driver having an axis oriented toward the listening area and at an angle to said second driver axis, the fourth driver configured for being coupled to a signal having components of a third channel for receiving said signal and directing sound with third channel components into the listening area at an angle to the second channel sound image;

when the first and second cabinets are adjacent to one another with the axis of the first and second devices facing forward to the listening area and the axes of the third and fourth drivers directed inwardly to a location in the listening area between the first and second cabinets, the third and fourth drivers being operable for creating, in the listening area location between the first and second channel sound images, a focused sound image having components of a third channel to provide a listener in the listening area with at least three sound images generated from two sound cabinet locations to create a more realistic sound presentation for the listener.

2. The loudspeaker system of claim 1 wherein the axis of the third driver is angled with respect to the first driver axis in a range of approximately 20 to 45 degrees.

3. The loudspeaker system of claim 1 wherein the axis of the fourth driver is angled with respect to the second driver axis in a range of approximately 20 to 45 degrees.

4. The loudspeaker system of claim 1 wherein the first driver is further operable for receiving a left channel signal and generating a left channel sound image.

5. The loudspeaker system of claim 1 wherein the second driver is further operable for receiving a right channel signal and generating a right channel sound image.

6. The loudspeaker system of claim 1 wherein one of said third and fourth drivers is further operable for receiving a signal having components of a center channel and generating a center channel sound image.

7. The loudspeaker system of claim 1 wherein one of said third and fourth drivers is further operable for receiving a signal which is a combination of a left channel signal and a center channel signal for generating a sound image with said components of the left and center channels.

8. The loudspeaker system of claim 1 wherein one of said third and fourth drivers is further operable for receiving a signal which is a combination of a right channel signal and a center channel signal for generating a sound image with sound components of the right and center channels.

9. An acoustic system for producing, in a listening area, realistic sound images from multiple channels, the system comprising:

an audio signal generator operable for generating at least first, second and third channel signals;

two spaced-apart sound cabinets for housing speaker drivers;

a first speaker driver mounted in a first of the cabinets and having an axis directed toward the listening area, the first driver electrically coupled to said audio signal generator for receiving said first channel signal, the first driver operable for creating a first channel sound image forward of the cabinet into the listening area;

a second speaker driver mounted in a second of the cabinets and having an axis directed toward the listening area, the second driver electrically coupled to said audio signal generator for receiving said second channel signal, the second driver operable for creating a second channel sound image forward of the cabinet into the listening area;

a third speaker driver mounted in said first cabinet and physically spaced from said first driver, the third driver having an axis oriented toward the listening area and at an angle to said first driver axis, the third driver electrically coupled to said audio signal generator for receiving a signal having components of a third channel, the third driver operable for directing sound with third channel components into the listening area at an angle to the first channel sound image;

a fourth speaker driver mounted in said second cabinet and spaced from said second driver, the fourth driver having an axis oriented toward the listening area and at an angle to said second driver axis, the fourth driver electrically coupled to said audio signal generator for receiving a signal having components of a third channel, the fourth driver operable for directing sound with third channel components at an angle to the second channel sound image;

when the first and second cabinets are adjacent to one another with the axis of the first and second drivers facing the listening area and the axes of the third and fourth drivers directed inwardly to a location in the listening area between the first and second cabinets, the third and fourth drivers being operable for creating, in the listening area location between the first and second channel sound images, a focused sound image having components of a third channel to provide a listener in the listening area with at least three sound images generated from two sound cabinet locations to create a more realistic sound presentation for the listener.

10. The acoustic system of claim 9 wherein the axis of the third driver is angled with respect to the first driver axis in a range of approximately 20 to 45 degrees.

11. The acoustic system of claim 9 wherein the axis of the fourth driver is angled with respect to the second driver axis in a range of approximately 20 to 45 degrees.

12. The acoustic system of claim 9 wherein the audio signal generator outputs a left channel signal and the first driver is further operable for receiving said left channel signal and generating a left channel sound image.

13. The acoustic system of claim 9 wherein the audio signal generator outputs a right channel signal and the second driver is further operable for receiving said right channel signal and generating a right channel sound image.

14. The acoustic system of claim 9 wherein the audio signal generator produces a center channel signal and a signal with said third and fourth drivers are operable for receiving a signal with center channel components to generate a center channel sound image.

15. A method for producing realistic sound images from an audio signal generator with a multiplicity of audio signal channels, the method comprising:

positioning a first speaker driver to be oriented generally toward a predetermined area;

coupling the first driver to a first channel signal of said audio signal generator, the first driver operable for receiving said first channel signal and creating a first channel sound image in the area forward of the first driver;

positioning a second speaker driver at a location spaced from the first speaker driver to also be oriented generally toward said predetermined area;

coupling the second driver to a second channel signal of said audio signal generator, the second driver operable for receiving said second channel signal and creating a second channel sound image in the area forward of the second driver;

positioning a third speaker driver proximate to said first driver and oriented generally toward the area at an angle to said first driver;

coupling the third driver to a signal having components of a third channel from said audio signal generator, the third driver operable for receiving said signal and creating sound with third channel components in the area at an angle to the first channel sound image;

positioning a fourth speaker driver proximate to said second driver and oriented generally toward the area at an angle to said second driver;

coupling the fourth driver to a signal also having components of said third channel from said audio signal generator, the fourth driver operable for receiving said signal and creating sound with third channel components at an angle to the second channel sound image;

placing the drivers adjacent to one another with the first and second drivers generally oriented to produce adjacent sound images in the area and the third and fourth drivers directed inwardly of the direction of the first and second drivers such that the third and fourth drivers collectively present a focused sound image having components of said third channel in the area and between the first and second channel sound images to provide a listener with at least three sound images generated from generally two locations whereby a more realistic sound presentation is created for the listener.

16. The method of claim 15 further comprising positioning the third driver such that it is angled with respect to said first driver in a range of approximately 20 to 45 degrees.

17. The method of claim 15 further comprising positioning the fourth driver such that it is angled with respect to said second driver in a range of approximately 20 to 45 degrees.

18. The method of claim 15 further comprising coupling the first driver to a left channel signal for generating a left channel sound image.

19. The method of claim 15 further comprising coupling the second driver to a right channel signal for generating a right channel sound image.

20. The method of claim 15 further comprising coupling one of said third and fourth drivers to a center channel signal for generating a sound image having center channel components.

21. The method of claim 15 further comprising coupling one of said third and fourth drivers to a signal which is a combination of a left channel signal and a center channel signal for generating a sound image with sound components of the left and center channels.

22. The method of claim 15 further comprising coupling one of said third and fourth drivers to a signal which is a combination of a right channel signal and a center channel signal for generating a sound image with sound components of the right and center channels.

23. A loudspeaker system for producing realistic sound images from an audio signal generator with a multiplicity of audio signal channels, the system comprising:

a first speaker driver mounted in a sound cabinet, the first driver configured for being coupled to a first channel signal of said audio signal generator and operable for receiving said first channel signal and creating a first channel sound image, the first speaker driver directing said first channel sound image into an area forward of the driver;

a second speaker driver mounted in a second sound cabinet, the second driver configured for being coupled to a second channel signal of said audio signal generator and operable for receiving said second channel signal and creating a second channel sound image, the second speaker driver directing said second channel sound image into an area forward of the driver;

a third speaker driver mounted in said first cabinet and physically spaced from said first driver, the third driver being oriented at an angle to said first driver and configured for being coupled to a signal having components of a third channel from said audio signal generator, the third driver operable for receiving said signal and directing sound with third channel components forward of the driver at an angle to the first channel sound image;

a fourth speaker driver mounted in said second cabinet and physically spaced from said second driver, the fourth driver being oriented at an angle to said second driver, and configured for being coupled to a signal also having components of a third channel from said audio signal generator, the fourth driver operable for receiving said signal and directing sound with third channel components forward of the driver at an angle to the second channel sound image;

when the first and second cabinets are adjacent to one another with the first and second drivers generally oriented to produce first and second channel sound images generally adjacent to one another, the third and fourth drivers being directed at an angle inwardly of the direction of the first and second drivers and being operable for collectively creating, between the first and second channel sound images, a focused sound image having components of said third channel to provide a listener with at least three channel sound images generated from two sound cabinet locations to create a more realistic sound presentation for the listener.

24. The loudspeaker system of claim 23 wherein the third driver is angled with respect to the first driver in a range of approximately 20 to 45 degrees.

25. The loudspeaker system of claim 23 wherein the fourth driver is angled with respect to the second driver in a range of approximately 20 to 45 degrees.

26. The loudspeaker system of claim 23 wherein the first driver is further operable for receiving a left channel signal and generating a left channel sound image.

27. The loudspeaker system of claim 23 wherein the second driver is further operable for receiving a right channel signal and generating a right channel sound image.

28. The loudspeaker system of claim 23 wherein one of said third and fourth drivers is further operable for receiving a signal having components of a center channel and generating a center channel sound image.

29. The loudspeaker system of claim 23 wherein one of said third and fourth drivers is further operable for receiving a signal which is a combination of a left channel signal and a center channel signal for generating a sound image with said components of the left and center channels.

30. The loudspeaker system of claim 23 wherein one of said third and fourth drivers is further operable for receiving a signal which is a combination of a right channel signal and a center channel signal for generating a sound image with sound components of the right and center channels.

* * * * *

Disclaimer 5,557,680—Thomas A. Janes, Cincinnati, Oh. LOUDSPEAKER SYSTEM FOR PRODUCING MULTIPLE SOUND IMAGES WITHIN A LISTENING AREA FROM DUAL SOURCE LOCATIONS. Patent dated Sep. 17, 1996. Disclaimer filed Nov. 1, 2004, by the assignee, Bose Corporation.

Hereby disclaims the entire term of said patent.

*(Official Gazette March 15, 2005)*